US009947454B2

(12) United States Patent
Dahlund

(10) Patent No.: US 9,947,454 B2
(45) Date of Patent: Apr. 17, 2018

(54) MODULAR INSULATION FLUID HANDLING SYSTEM

(71) Applicant: ABB Schweiz AG, Baden (CH)

(72) Inventor: Mats Dahlund, Söderbärke (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/129,013

(22) PCT Filed: Mar. 27, 2015

(86) PCT No.: PCT/US2015/056767
§ 371 (c)(1),
(2) Date: Sep. 26, 2016

(87) PCT Pub. No.: WO2015/150276
PCT Pub. Date: Oct. 8, 2015

(65) Prior Publication Data

US 2017/0103840 A1 Apr. 13, 2017

(30) Foreign Application Priority Data

Apr. 3, 2014 (EP) ..... 14163310

(51) Int. Cl.
*H01F 27/02* (2006.01)
*H01F 27/14* (2006.01)
*H01F 27/08* (2006.01)

(52) U.S. Cl.
CPC ..... *H01F 27/14* (2013.01); *H01F 27/02* (2013.01); *H01F 27/08* (2013.01)

(58) Field of Classification Search
CPC ..... H01F 27/00–27/36
(Continued)

(56) References Cited

U.S. PATENT DOCUMENTS 4,276,530 A * 6/1981 Benke ..... H01F 27/18 165/104.27
4,593,532 A * 6/1986 Kimura ..... H01F 27/18 165/104.21

(Continued)

FOREIGN PATENT DOCUMENTS

DE 3206368 A1 9/1983
EP 2927916 A1 10/2015

(Continued)

OTHER PUBLICATIONS

Anonymous: "GATRON : techn_hermet_d", Jun. 17, 2012 (Jun. 17, 2012), Retrieved from the Internet: URL:http://web.archive.org/web/20120617154802/http://www.gatron.de/Technologie/techn_hermet ct.html ; [retrieved on Jul. 16, 2015].

(Continued)

*Primary Examiner* — Tuyen Nguyen
(74) *Attorney, Agent, or Firm* — Whitmyer IP Group LLC

(57) ABSTRACT

A modular insulation fluid handling system for protecting insulation fluid of an inductive power device having an expansion vessel and for handling volume variations of the insulation fluid, the modular insulation fluid handling system includes a first protective housing including a resilient reservoir filled with an inert gas, a connector, and an adapter sealably connected to the inside of the resilient reservoir, an interface including a ventilation duct terminal and a reservoir terminal being sealably connected to the adapter, the connector is arranged between the adapter and the interface and configured to be connected to a connector of a second protective housing, and a vessel ventilation duct configured to be sealably connected to the expansion vessel and the ventilation duct terminal. The inside of the resilient reservoir is configured to be in hermetically sealed fluid communica- (Continued)

tion with the expansion vessel via the adapter, the interface and the vessel ventilation duct.

12 Claims, 4 Drawing Sheets

(58) Field of Classification Search
USPC ..... 336/55–62, 90, 92
See application file for complete search history.

(56) References Cited

U.S. PATENT DOCUMENTS

| | | | | |
|---|---|---|---|---|
| 4,607,245 | A * | 8/1986 | Kuroda | H01F 27/18 174/11 R |
| 5,336,847 | A * | 8/1994 | Nakagami | C10M 169/04 174/15.1 |
| 2006/0208843 | A1 | 9/2006 | Sabau | |
| 2008/0100972 | A1 | 5/2008 | Magnier | |
| 2011/0114364 | A1 * | 5/2011 | Braesel | H01F 27/14 174/12 R |

FOREIGN PATENT DOCUMENTS

| | | | |
|---|---|---|---|
| GB | 929692 | A | 6/1963 |
| GB | 945688 | A | 1/1964 |
| JP | S577911 | A | 1/1982 |
| JP | S5730302 | A | 2/1982 |
| JP | 2006295017 | A | 10/2006 |

OTHER PUBLICATIONS

European Search Report Application No. 14163310.7 Completed Sep. 15, 2014;dated Sep. 25, 2014 7 pages.

International Preliminary Report on Patentability Application No. PCT/EP2015/056767 Completed: Jun. 20, 2016;dated Jun. 20, 2016 7 pages.

International Search Report & Written Opinion of the International Searching Authority Application No. PCT/EP2015/056767 Completed: Jul. 16, 2015;dated Jul. 24, 2015 12 pages.

Klaus Olbricht et al: "Top Solutions for Transformer Life Time Extensions S5 1", Oct. 23, 2013 (Oct. 23, 2013), Retrieved from the Internet: URL:http://www.energy-support.de/de/compon ent/phocadownload/category/4-seminars-tlm-layout.html?download=57:klaus-olbricht-emb-germany , [retrieved on Jul. 13, 2015] p. 4-p. 9; figure 5.

Written Opinion of the International Preliminary Examining Authority Application No. PCT/EP2015/056767 dated Mar. 15, 2016 7 pages.

* cited by examiner

MODULAR INSULATION FLUID HANDLING SYSTEM

TECHNICAL FIELD

The invention relates to the field of inductive power devices, specifically to the field of power transformers and reactors comprising an insulation fluid such as oil and a conservator in the form of an expansion vessel for the insulation fluid. The level of the insulation fluid in the power transformers is thereby exposed to fluctuations due to heating and cooling of the insulation fluid by the power transformer. The fluctuations or variations of the fluid level are compensated in an expansion vessel, whereby the insulation fluid has a free surface, which is exposed to a gas. The invention relates to a system that is used to control the pressure and composition of the gas, that comes in contact with the free surface.

BACKGROUND

It is commonly known that insulating oil, such as mineral oil, is used in power transformers. A number of methods and treatments are known to treat insulating oil and to avoid the contamination thereof. Specifically oxygen and water can contaminate the insulating oil at the free surface in the expansion vessel and cause oxidation and humidification. Usually the insulating oil has a free surface to avoid pressure injuries or the like, since a high pressure should be avoided even when the insulating oil is heated by the power transformer. Many power transformers up to today are so called free breathers, which means that the free surface of the insulating oil in the expansion vessel is exposed to the atmosphere and therefore to particles, oxygen and water. In a free breather power transformer there is no gas tight barrier between the gas that comes into contact with the free surface of the insulating fluid and the atmosphere. The gas is thus normally air. However, it is common practice to have an in-line cartridge filled with some drying agent, such as silica gel, as a moisture barrier against the ambient air.

It is known in the prior art to use some kind of diaphragm, which is arranged to be in fluid communication with the free surface of the insulating oil in the conservator. The diaphragm is used to isolate the gas in contact with the free surface of the insulating oil from the atmosphere and specifically from oxygen and water. The diaphragm has a low permeability to oxygen and water.

GB 945,688 discloses an apparatus permitting a liquid contained in a reservoir, such as an expansion vessel, to expand and contract freely without coming into contact with the outside atmosphere and thus without the risk of humidification and/or oxidation by that outside atmosphere. The reservoir contains an inert gas in communication with a diaphragm container exposed to the outside atmosphere and comprising resilient means. The resilient means are used to provide a pressure of the inert gas slightly below and slightly above the atmospheric pressure when the level or volume of the liquid varies. GB 945,688 further discloses to install a dryer in the path of the inert gas to permanently dry the inert gas, since the volume comprising the inert gas is not completely air tight, allowing oxygen, water or vapour to enter the volume comprising the inert gas and eventually contaminate the insulating oil.

The apparatus of GB 945,688 is expensive to install and it is not modular, thus it cannot be extended, for example in case the transformer is replaced by a bigger transformer. Further, the apparatus must be fixedly installed with a power transformer during assembly/production of it;—Retrofitting the apparatus of GB 945,688 to an existing transformer is not easy and it may involve high cost. In addition the apparatus of GB 945,688 does not illustrate the use of a back pressure device or the like for enhancing the safety of the system.

Other known solutions comprise so called continuous degasser devices, which draw oil directly from the main tank of the transformer or reactor and continuously degas said oil. Such solutions, if they work as intended, have the side effect that the interpretation of dissolved gas analysis becomes very difficult. Additionally continuous degassers are expensive, require regular maintenance and many continuous degassers do not reduce the oxygen to an acceptable level, at least not when considering the cost of installing and maintaining them.

JP 2006 295017 discloses a conservator which makes a moisture absorbent such as silica gel unnecessary. The conservator comprises an oil storage which is arranged in communication with an oil-containing electric device containing insulating oil sealed therein, and stores the insulating oil flowing in/from the oil-containing electric device, and a gas storage which stores gas to isolate the gas hermetically from the fresh air. The gas storage is capable of changing its shape in response to the flow of the gas caused by the inflation/shrinkage of the insulating oil. The gas storage has a bag-like body or a sheet-like body that changes its shape to store the flowing gas.

SUMMARY

It is an object of the present invention to provide a modular insulation fluid handling system that is economic, reliable when in use and easy to handle and install.

Disclosed herein is a modular insulation fluid handling system for protecting insulation fluid of an inductive power device having an expansion vessel and for handling volume variations of said insulation fluid. The modular insulation fluid handling system comprises at least a first protective housing comprising a resilient reservoir filled with an inert gas, a connector, and an adapter sealably connected to the inside of the resilient reservoir, an interface comprising a ventilation duct terminal and a reservoir terminal being sealably connected to the adapter, wherein the connector is arranged between the adapter and the interface and configured to be connected to a connector of a second protective housing, and a vessel ventilation duct configured to be sealably connected to the expansion vessel and the ventilation duct terminal. The inside of the resilient reservoir is configured to be in hermetically sealed fluid communication with the expansion vessel via the adapter, the interface and the vessel ventilation duct. Thereby, the inert gas may be protected (e.g. completely) from ambient influences. The first and second protective housings may each be a collapsible or foldable container. By enabling connection between the first and second protective housings, by means of the connectors, the insulation fluid handling system is modular. Any number of further (third, forth etc.) protective housings and resilient reservoirs therein may be connected in the system as suitable depending on the size of the inductive power device.

The adapter may for example be glued or welded to the resilient reservoir. This may provide for a hermetically sealed and air and water tight connection. The reservoir terminal may further also be connected, for example via an interface connection duct, to the adapter in a hermetically sealed manner that is air and watertight. Also the vessel ventilation may be connected in a hermetically sealed and air/water tight manner to the expansion vessel and the ventilation duct terminal.

Such a system may be installed on a power transformer that is a free breather and already in use. The system may e.g. be retro fitted. Additionally the system is modular and may be easy to transport. It may be separated into various comparably small parts, the biggest part or component being the protective housing. Due to the modularity the system may be used for power transformers with various sizes.

Additionally, it may be comparably easy to replace the resilient reservoir in the modular insulation fluid handling system due to the build up of the modular insulation fluid handling system.

The resilient reservoir may need to be replaced every 10 to 20 years due to aging.

In an embodiment the resilient reservoir may comprise a multilayer polymer film or metal foil that prevents water and oxygen from entering into the resilient reservoir.

The metal foil may be embedded in the between polymer layer films in a multilayer polymer film/structure.

The volume containing the inert gas may thus protected such that it cannot be contaminated with oxygen, water/vapour and particles or dust.

Advantageously the multilayer polymer film comprises ethylene vinyl alcohol (EVOH), Polyethylene (PE) and/or polyvinylidene chloride (PVDC).

Materials such as EVOH and PVDC provide for a relatively good flexibility and limited elasticity, while providing an efficient moisture and oxygen barrier.

In another embodiment the interface may comprise a back pressure device configured to limit an overpressure of the inert gas in the closed volume. This may counteract diffusion of oxygen/ambient air and water into the closed volume.

The overpressure versus the ambient pressure may be very low, e.g. as low as possible. The overpressure limit of a back pressure device may be adjustable.

The back pressure device may be a back pressure regulator or a planar bursting element.

A planar bursting element may be configured to burst as soon as the overpressure limit in the closed volume is too high. This overpressure limit may be adjustable by an operator. After each burst, the planar bursting element needs to be replaced. The planar bursting element may be a bursting disc, a bursting sheet metal, a bursting planar plastic element or the like.

A back pressure regulator may be reusable in that as soon as the overpressure limit is reached the back pressure regulator opens and closes again as the pressure in the closed volume is going below the overpressure limit.

The closed volume comprising the inert gas may comprise of the inside of the resilient reservoir, the inside of the adapter, the inside of the interface or parts of it and the inside of the vessel ventilation duct and the free space in the expansion vessel.

Depending on the modular configuration, the closed volume may additionally comprise the inside of various other ducts such as the interface connection duct and/or the housing connection duct.

The pressure in the closed volume may be the same as the ambient pressure or only slightly higher.

The pressure difference between the inside of the closed volume, respectively, and the outside of the closed volume may be zero or 0.01 bar to maximal 0.5 bar, preferably maximal 0.1 bar, whereby the pressure in the closed volume is slightly higher.

In a further embodiment the protective housing may be a collapsible plastic pallet container. A collapsible plastic pallet container can be folded and it is a standard product that may be easily obtained.

The resilient reservoir may be a flexible and/or foldable bag.

The flexible bag and the resilient reservoir, respectively, may have a volume of around 1 $m^3$. 1 $m^3$ of inert gas may be needed for a range of 5 $m^3$ of insulation fluid/insulation oil to 20 $m^3$ of insulation fluid/insulation oil.

Thus one resilient reservoir having a volume of 1 $m^3$ of inert gas may be used for a range of 5 $m^3$ to 20 $m^3$ of insulation oil/fluid. In case there is a higher volume of insulation fluid or insulation oil within the transformer, another resilient volume and protective housing may be added to the fluid handling system.

The resilient reservoir may have another specific size and it may comprise less or more than 1 $m^3$ of inert gas.

In another embodiment, the interface comprises a filling valve fluidically connected to the adapter, said filling valve being used for topping up or filling the inert gas in the resilient reservoir.

"Topping up" implies that the filling valve is used to refill the resilient reservoir and the closed volume with inert gas, once some of the inert gas is absorbed by the insulation fluid.

When filling the volume or modular insulation fluid handling system, the nitrogen from a nitrogen cylinder may be used. As an example a 5 liter container of nitrogen at a pressure of 200 bars may be used to fill one resilient reservoir. Therefore a system with two protective housings and thus two units may require 10 liter of nitrogen at 200 bars or a 10 liter nitrogen cylinder.

The resilient reservoir may have another volume; it may be smaller or bigger than the above stated.

The resilient reservoir may be configured to receive a volume of inert gas being in the range of 0.1-10 $m^3$.

The inert gas may be nitrogen or any other suitable gas that is inert.

In an embodiment the adapter may be arranged so that it extends through a lid of the protective housing. The interface may be arranged on a side wall of the protective housing, said interface and adapter may be fluidically interconnected via the interface connection duct.

This eases the installation of the modular insulation fluid handling system and the placing of the components, in particular the protective housings.

In a further embodiment the interface may be arranged at the first protective housing as seen from the expansion vessel.

Alternatively the interface may be positioned at any position in the modular insulation fluid handling system.

Only one interface may be needed even in case there are more than two protective housings and resilient reservoirs installed.

Advantageously, at least the first protective housing may comprise a connector arranged in between the adapter and the interface, said connector being configured to be connected to the connector of the second protective housing.

The second protective housing may be a second collapsible or foldable container.

The first and second protective housings and any additional protective housing may be connected one after the other, so that a slight overpressure in the closed volume does not increase when the second protective housing is connected. Thus the protective housings are basically connected in parallel.

The connector may be a T-connector, whereby the T-connector is sealably connected to interface, the adapter and a protective housing connection duct. At least one opening of the T-connector of the last protective housing in the series is blocked or plugged so that no air or moisture can enter the closed volume or system.

In a further embodiment the modular insulation fluid handling system may comprise a protective housing connection duct, configured to interconnect the connectors of the at least first and second protective housings.

One housing connection duct and a protective housing together with the adapter, the connector and the resilient reservoir may form a unit.

In another embodiment each protective housing together with the adapter, the connector, the resilient reservoir and the housing connection duct may form a module or unit so that the modular insulation fluid handling system can be extended in case a higher volume of inert gas is needed to handle the insulation fluid.

The protective housing may be a foldable housing or container.

Disclosed herein is further a method of installing the fluid handling system on an existing transformer system comprising the step of:

degassing the insulation oil in the transformer or reactor (this step is optional);

assembling the protective housing or housings and resilient reservoir and installing the interface, the adapter, the connector, the interface connection duct and the vessel ventilation duct of the fluid handling system;

connecting the vessel ventilation duct to the expansion vessel of the transformer system; and filling and pressurizing the fluid handling system with inert gas from the resilient reservoir or from another gas source e.g. a gas cylinder.

The vessel ventilation duct and the free space of the expansion vessel may be filled and pressurized with inert gas by opening a release valve or the like, said valve being arranged close to the expansion vessel, and by closing the valve as soon as inert gas is escaping through the valve.

The method may further include installing and connecting a second protective housing and resilient reservoir, respectively, by connecting the T-connector of the first protective housing with the T-connector of the second protective housing.

A plurality of protective housings, thus second, third, fourth, etc. protective housings and thus resilient reservoirs may be installed and connected in parallel with each other and with the first protective housing and resilient reservoir, respectively.

By means of embodiments of the present invention, a simple solution is provided, without the need for a manometer, back-pressure valve and/or gas pumps. Further, the gas in the expansion vessel and the resilient reservoir need never be in contact with ambient e.g. air.

Generally, all terms used in the claims are to be interpreted according to their ordinary meaning in the technical field, unless explicitly defined otherwise herein. All references to "a/an/the element, apparatus, component, device, system, arrangement, step, etc." are to be interpreted openly as referring to at least one instance of the element, apparatus, component, device, system arrangement, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Herein, the term fluid or insulation fluid is interchangeable with the term oil or insulating oil.

Figure 1:
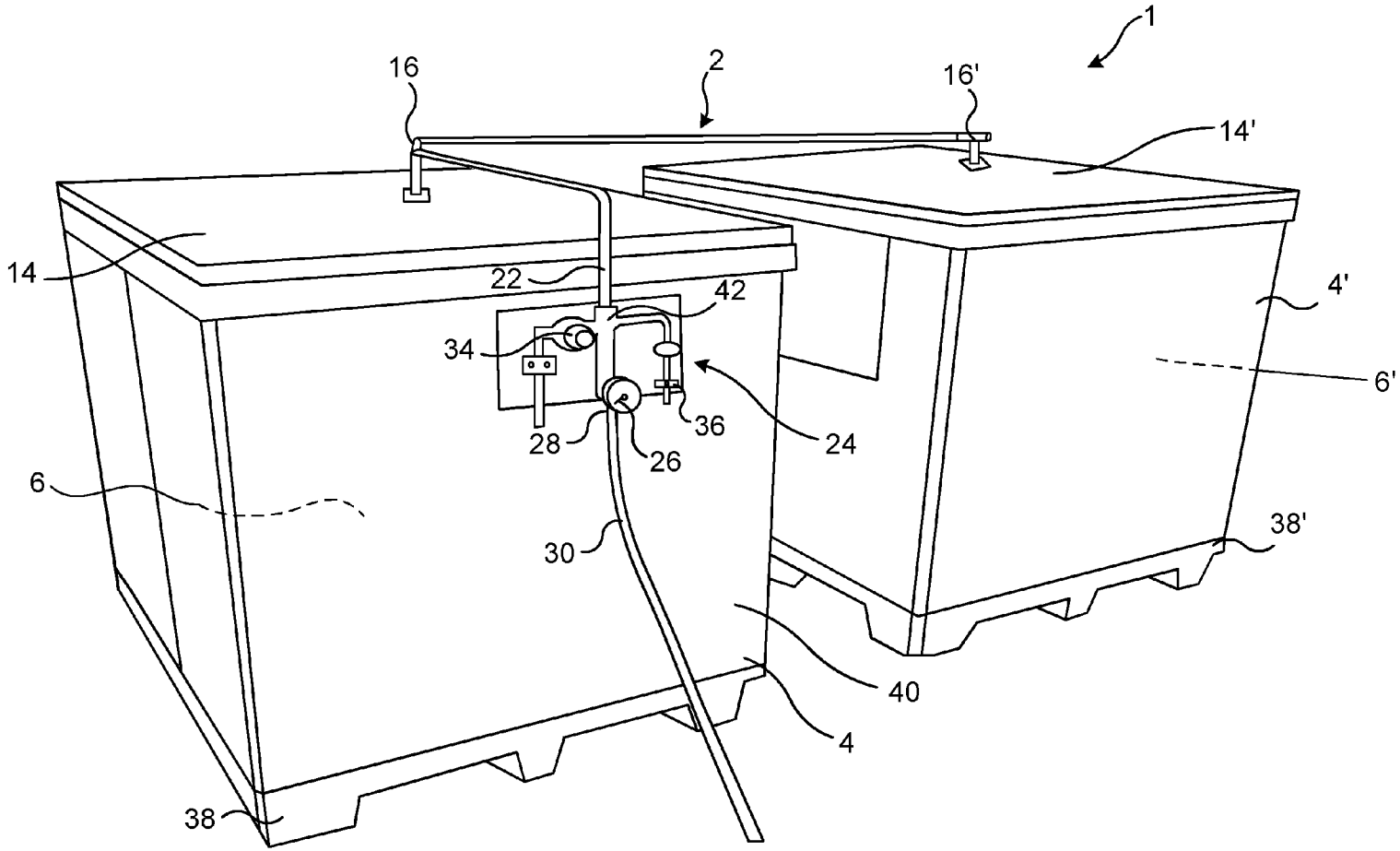
FIG. 1 illustrates in a perspective view a modular insulation fluid handling system according to the invention with two protective housings.

FIG. 1 illustrates a modular insulation fluid handling system 1 that can balance pressure and volume variations of an insulation fluid that is used in an inductive power device and a conservator thereof, respectively. The modular insulation fluid handling system 1 comprises a pipe arrangement 2 and a protective housing 4, 4' and it is configured to be easily transported and installed on site. The inductive power device may be a low, medium or high voltage transformer or reactor. The modular insulation fluid handling system 1 can be fitted to a so called free breather transformer that is already in use. As explained later herein, the protective housing 4, 4' and the pipe arrangement 2 can be transported in a simple and space saving manner and the modular insulation fluid handling system 1 can be installed by one person. All the components are comparably light and easy to handle.

The conservator of a power transformer may comprise an expansion vessel (not shown) into which the insulation fluid may expand when the power transformer is heating the insulation fluid, such as for example mineral oil, silicon oil or ester, so that the volume increases. Usually a free surface of the insulation oil or insulation liquid in the expansion vessel is in contact with gas, which may be air (free breather transformer). Air comprises oxygen, moisture and small particles. These substances may damage the insulation fluid and the power transformer, respectively and decrease their lifespan. For these reasons the gas, which is in contact with the free surface of the insulation fluid may be embedded in a closed volume or environment. This closed volume may comprise a resilient reservoir 6 or membrane in order to balance the pressure of the gas when temperature variations in the power transformer cause the volume of the insulation fluid to decrease and increase.

Figure 6:
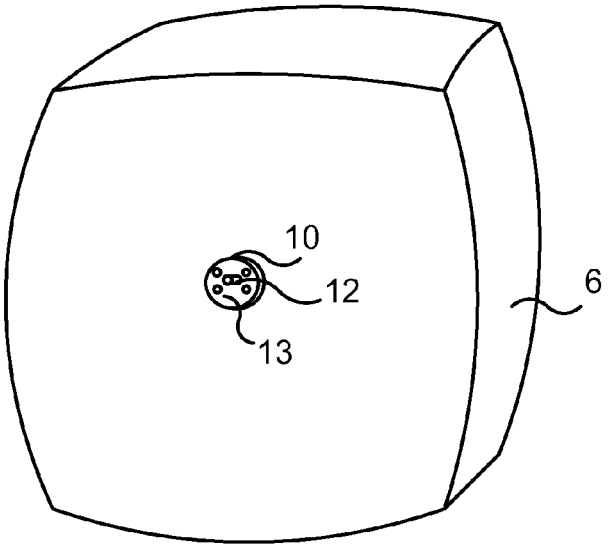
FIG. 6 illustrates schematically a perspective view of the resilient reservoir.
Figure 7:
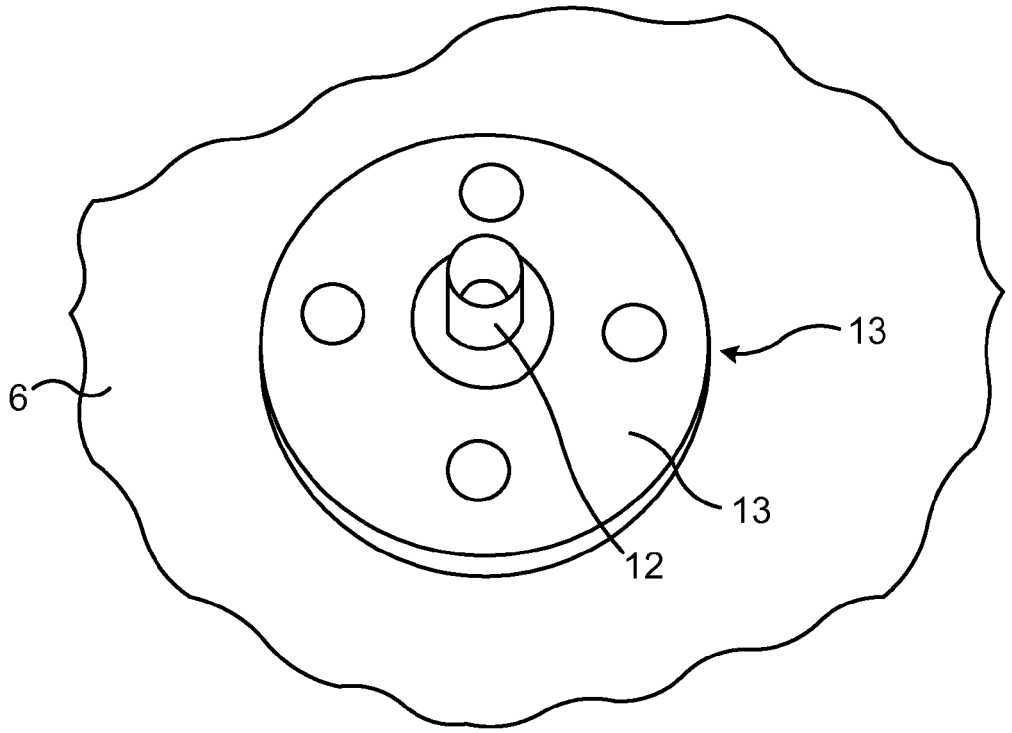
FIG. 7 illustrates schematically a perspective view of an adapter glued or welded to the resilient reservoir.

The protective housing 4, 4' comprises a resilient reservoir 6 arranged to be embedded in the protective housing 4, 4', said resilient reservoir 6 may for example be embodied in the form of a plastic bag comprising a multilayer plastic film. The resilient reservoir 6 is illustrated in fully filled and expanded form in FIG. 6 and configured to be embedded in the protective housing 4, 4' of FIG. 1. The resilient bag 6 further comprises an adapter 10 that is glued or welded to the resilient reservoir 6 (c.f. FIG. 7). The multilayer plastic film may form the margin of the resilient reservoir 6 or flexible bag or it may be a separate layer on the polymer or plastic of the resilient reservoir 6. The resilient reservoir 6 is configured to receive an inert gas such as nitrogen or any other suitable inert gas, as illustrated in FIG. 6.

The multilayer plastic film may comprise a three-layer outer film comprising Polyethylene (PE), Ethylene vinyl alcohol (EVOH) and again PE and an inner film comprising PE.

Figure 4:
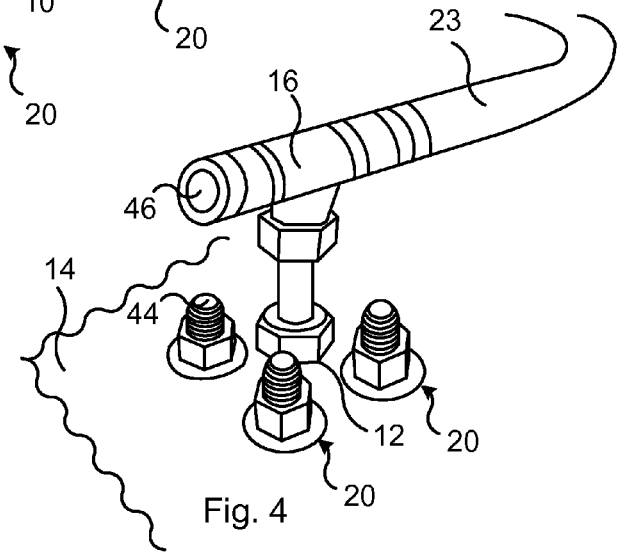
FIG. 4 illustrates a connector connected to the adapter.

The protective housing 4, 4' comprises a lid 14, a connector 16, a base 38 and sidewalls 40, which sidewalls are foldable or collapsible for easy transport as shown in FIG. 1. The connector 16 may be fluidically connected to the adapter 10 of the resilient reservoir 6 and thus the inside of the resilient reservoir 6. The connector 16 may be a T-connector as illustrated in FIG. 4. The T-connector may comprise a gas sampling port 17, which can be used for gas analysis.

The protective housing 4, 4' may be a standard plastic pallet container, for example an Accon Pallbox Pallet container, as indicated in FIG. 1.

Figure 2:
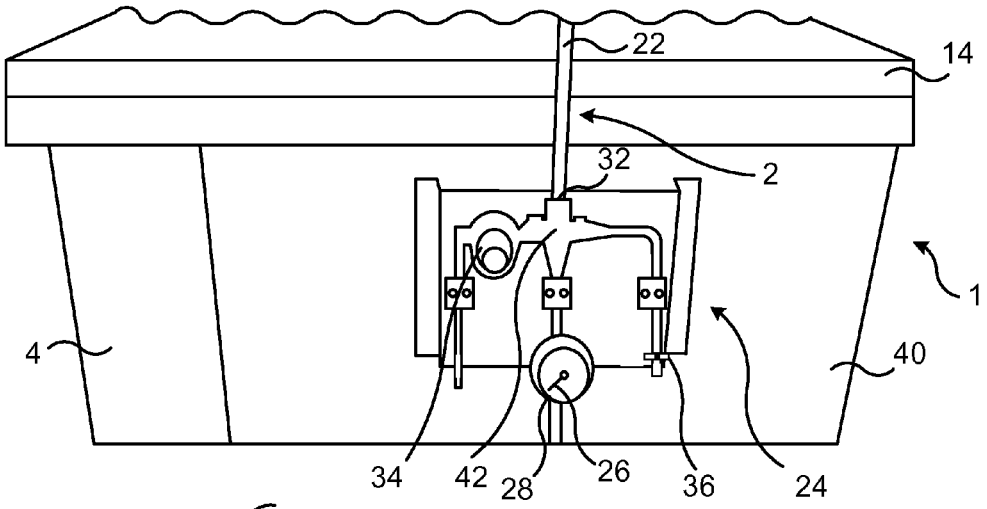
FIG. 2 illustrates schematically a front view on an interface of the modular insulation handling system according to the invention.

Turning now to FIGS. 1 and 2, the pipe arrangement 2 comprises an interface 24, an interface connection duct 22, which connects the adapter 10 and the connector 16, respectively, to the interface 24, a vessel ventilation duct 30 that fluidically connects the interface 24 with the inside of the expansion vessel and, in case more than one protective housings 4, 4' are installed, a housing connection duct 23 that is configured to be sealably connected to the T-connector 16 of the first protective housing 4 and the T connector 16' of the second protective housing 4', as best illustrated in FIG. 1.

The first and second protective housings 4, 4' may be embodied in the form of collapsible or foldable housings or collapsible containers, as shown in FIG. 1.

The interface 24 comprises an optional pressure gauge 26, a ventilation duct terminal 28, a reservoir terminal 32, a back pressure regulator 34, a filling valve 36 and four-way or cross connector 42, as best illustrated in FIGS. 1 and 2.

In the FIGS. 1 and 2 the fluid handling system 1 is illustrated having a back pressure regulator 34.

It falls within this invention to provide a planar bursting element instead of the back pressure regulator 34.

The four-way or cross connector 42 is fluidically connected to the ventilation duct terminal 28, the reservoir terminal 32, the back pressure regulator 34 and the filling valve 36.

The back pressure regulator 34 is configured to release nitrogen immediately in case there is an overpressure in the system or the closed volume in order to avoid an overpressure, which in case of a sudden pressure drop, can lead to nitrogen bubble formation in the insulation oil.

The terminals 28, 32, the ducts 22, 23, 30, the connector 16, 16' and the filling valve 36 may comprise a latching mechanism, a bayonet nut connector or thread/screw connection for connecting the ducts (not shown). Any other suitable connection mechanism may be used.

The ducts 22, 23, 30 may be flexible steel tubes.

Turning now to FIG. 1, the protective housing 4, 4' and the resilient reservoir 6, respectively, may be connected to an inlet/outlet (not shown) of the conservator and the expansion vessel, respectively, via the vessel ventilation duct 30, shown in FIG. 1 and the adapter 10 and T-connector 16. The interface connection duct 22 interconnects the connector 16 with the reservoir terminal 32 of the interface 24. The connections between all these elements, namely the expansion vessel and the vessel ventilation duct 30, the vessel ventilation duct 30 and the interface 24, the interface 24 and the interface connection duct 22, the interface connection duct 22 and the connector 16, the connector 16 and the adapter 10 and eventually the resilient reservoir 6 are sealed and air- and watertight. The inside or closed volume defined by the resilient reservoir 6, the adapter 10, the connector 16, the interface connection duct 22, the interface 24 and the vessel ventilation duct 30 and the inside of the expansion vessel that is not occupied by the insulation fluid, is thus hermetically sealed from the ambiance or surroundings. Moisture and oxygen from the ambiance or surroundings cannot enter the closed volume that is filled with the inert gas.

Alternatively to providing an interface 24, the adapter 10 may be directly connected to the vessel ventilation duct 30.

The multilayer plastic film may be made of or comprise a layer of metal foil, a multilayer polymer film with EVOH as the oxygen and moisture barrier and/or PVDC as the oxygen and moisture barrier and PE as a supporting layer. Other polymers that are suitable may be used.

The modular insulation fluid handling system 1 is configured to be installed with one, two or more protective housings 4, 4', depending on the volume of insulation oil that is present in the transformer or reactor.

The flexible bag and the resilient reservoir 6, 6', respectively, may have a volume of around 1 $m^3$. 1 $m^3$ of inert gas is needed for a range of 5 $m^3$ of insulation fluid/insulation oil to 20 $m^3$ of insulation fluid/insulation oil.

Thus one resilient reservoir 6, 6' having a volume of 1 $m^3$ of inert gas is used for a range of 5 $m^3$ to 20 $m^3$ of insulation oil. In case there is a higher volume of insulation fluid or insulation oil within the transformer or reactor, another resilient reservoir 6, 6' and protective housing 4, 4' may be added to the fluid handling system 1.

The resilient reservoir 6, 6' may have another specific size and it may comprise less or more than 1 $m^3$ of inert gas.

The resilient reservoir 6, 6' may have another volume; it may be smaller or bigger than the above stated.

The resilient reservoir 6, 6' may for example be configured to receive a volume of inert gas being in the range of 0.1-10 $m^3$.

FIG. 1 illustrates a first protective housing 4 and a second protective housing 4' connected in series. The modular insulation fluid handling system 1 comprises the protective housing connection duct 23 that interconnects the inside of the resilient reservoir 6 of the first protective housing 4 via the T-connector 16 of the first protective housing 4 with the T-connector 16' of the second protective housing 4' and thus with the resilient reservoir 6' of the second protective housing 4'. The adapter 10 of each of the first—and second resilient reservoir 6, 6' is connected to the lid 14, 14' of the corresponding protective housing 4, 4' and the T-connectors 16, 16' are arranged on top of the lids 14 of the first—and second protective housing 4, 4'. The interface 24 is fixedly arranged on one of the sidewalls 40 of the first protective housing 4. Even if two or more protective housings 4, 4' are connected in series there may only be one interface 24 needed in each modular insulation fluid handling system 1.

Alternatively the T-connectors 16, 16' may be arranged on the side of the protective housings 4, 4', so that the first and second, and potential subsequent protective housings 4, 4' can be stacked.

The interface 24 may be fixed to the protective housing 4 on site or it may be pre-fitted to the protective housing 4.

When the modular insulation handling system 1 is installed and all the ducts of the pipe arrangement 2 are connected, the closed volume may be filled with the inert gas via the filling valve 36. The filling valve 36, when in the open position, is fluidically connected to the reservoir terminal 32 and thus, via the interface connection duct 22, with the inside of the resilient reservoir 6, as best illustrated in FIGS. 1 and 2.

5-liter nitrogen ($N_2$) at 200 bars may be used to fill one resilient reservoir 6 and the corresponding ducts and terminals, thus the hermetically closed volume. If two protective housings 4, 4' are connected in series, a 10-liter nitrogen at 200 bars may be used to fill the hermetically closed volume, that now comprises two resilient reservoirs 6, 6' and corresponding ducts 22, 23, 30, terminals 28, 32 and connectors 16, 42.

In order to fill the hermetically closed volume, the nitrogen or inert gas cylinder is connected to the filling valve 36, while the filling valve 36 is in the closed position. After the connection is established, the filling valve 36 is opened and then the inert gas cylinder is opened, or vice versa. Then the system or closed volume is filled with the inert gas. The filling valve 36 is shown in FIGS. 1 and 2.

The resilient reservoir 6 is preferably folded prior to the filling of the closed volume with inert gas, in order to minimize the amount of air in the insulation fluid handling system 1.

The interface 24 shown in FIGS. 1 and 2 further comprises the back pressure regulator 34. The back pressure regulator 34 is configured to allow a very small overpressure in the closed volume of the fluid handling system 1. The smaller the overpressure is, the better. Due to temperature variations of the power transformer and thus of the insulation fluid, the volume of the insulation fluid varies.

The resilient reservoir 6, 6' comprises material that has almost an inexistent elasticity. In order to avoid the build of an overpressure in the closed volume, the back pressure regulator 34 will release excess-nitrogen as soon as the overpressure limit, which is preferably smaller than 0.5 bar, more preferably smaller than 0.1 bar, is reached.

It is important to avoid too high overpressure, thus the maximal overpressure limit within the closed volume is less than 0.5 bar.

The overpressure limit should be at most 0.5 bar, preferably 0.1 bar, more preferably 0.01 bar. If the overpressure is higher than the overpressure limit, the back pressure regulator opens and releases excess N2, as mentioned above.

An operator may monitor the overpressure versus ambient pressure in the modular insulation fluid handling system 1 and the closed volume, respectively, via the pressure gauge 26, as illustrated in FIGS. 1 and 2.

In case the insulation oil of the transformer or reactor has dissolved most of the nitrogen in the resilient bag 6, 6' the operator may refill the fluid handling system 1.

Figure 3:
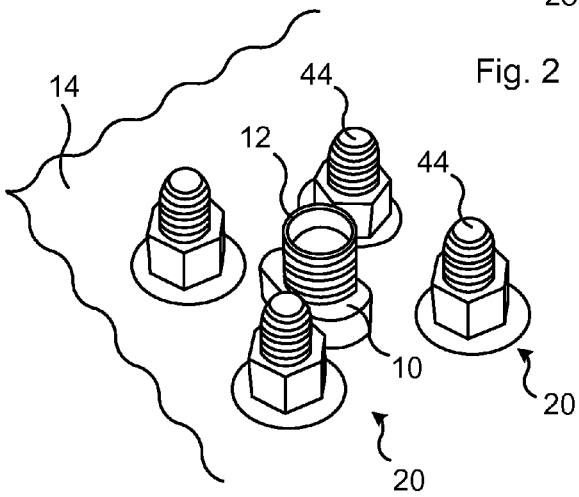
FIG. 3 schematically illustrates an adapter arranged in a lid of the protective housing, said adapter being sealably connected to a resilient reservoir of the protective housing.

Referring now specifically to FIGS. 3 to 4, which illustrate how the adapter 10 is fixed to the lid 14, or alternatively to any other (side-) wall 40 of the protective housing 4, 4'.

The adapter 10 may alternatively be fixed by the use of a bulkhead connector (not shown) through the lid.

Figure 5:
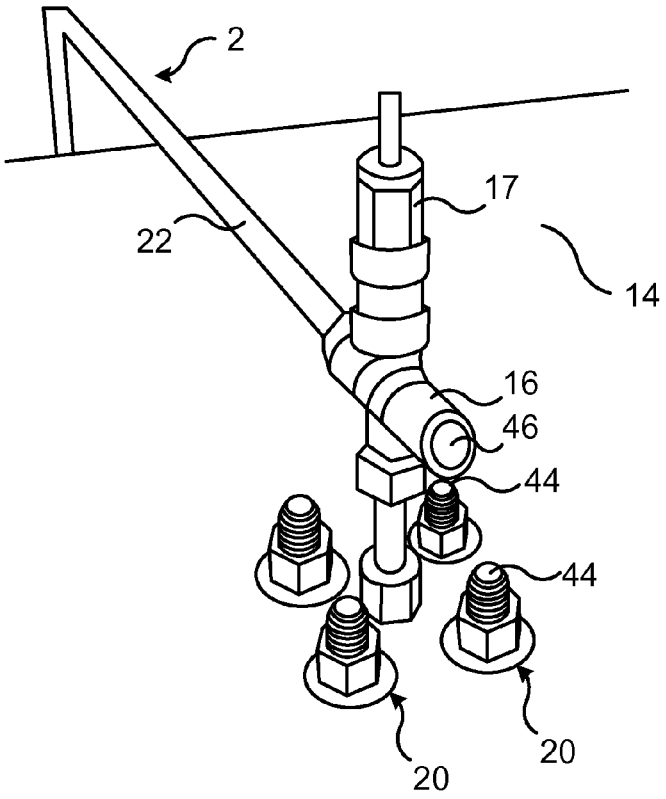
FIG. 5 illustrates another type of connector connected to the adapter.

The adapter 10 may comprise a protruding tube portion 12, which protrudes from one side of a round flange 13 (c.f. FIGS. 6 and 7), said protruding tube portion 12 being configured to extend through a hole in the lid 14, as best shown in FIG. 3. The protruding tube portion 12 may comprise a thread at a free end thereof, which thread may be connected to the connector 16 or T-connector as shown in FIGS. 4 and 5. The tube section of the protruding tube portion 12 extends from the free end all the way through the round flange 13 into the inside of the resilient reservoir 6, as shown in FIGS. 6 and 7. The round flange 13 may comprise four holes, arranged symmetrically so that threaded rods 44 or the like may engage the holes. The threaded rods 44 may then be put through pre-drilled holes in the lid 14 and fixed by nuts and washers 20, as best illustrated in FIGS. 3 to 5. Alternatively, the threaded rods 44 may be fixedly connected to the round flange 13 of the adapter 10, for example via welding or screwing (not shown).

The adapter 10 may alternatively be glued to the inside of the lid 14, with the protruding tube portion 12 extending through the hole in the lid 14 (not shown).

Turning now to FIG. 7, which illustrate how the adapter 10 with the protruding tube portion 12 may be glued or welded to the resilient reservoir 6, the round flange 13 of the adapter 10 is placed on the resilient reservoir 6 and glued or welded, for example by ultrasonic welding, to it.

In the illustrated case of FIG. 7, the adapter 10 is glued to the resilient reservoir 6.

In case the adapter 10 is welded, the side of the round flange 13 not comprising the protruding tube portion 12 may be covered with a layer of weldable polymer or plastic than can be welded with the material or plastic of the resilient reservoir 6, 6'.

The adapter 10 may be made of steel and comprise a modified flange to a 12 mm Swagelok steel adapter.

The adapter 10 is preferably pre-fixed to the resilient reservoir 6 and also tested for air- and moisture-tightness in the factory, so that it comes to the installation site as a finished unit ready to be installed.

FIG. 6 illustrates as an example the resilient reservoir 6 as a cube-shaped bag that has very low elastic properties. The resilient reservoir 6, 6' is configured to be embedded in the protective housing 4, 4', so that the protective housing 4, 4' may protect the resilient reservoir 6, 6', as shown in FIG. 1.

The modular insulation fluid handling system 1 may be used with a new power transformer system or it may be retro-fitted or retro-installed on a power transformer that is a free-breather and that is in use.

Alternatively the fluid handling system 1 may be used to refurbish an existing transformer, which has been originally fitted with a rubber bag in the conservator. The rubber bags tend to leak after the transformer has been in use for some years and the fluid handling system 1 is configured to replace such rubber bags.

The modular insulation fluid handling system 1 may be transported in pieces, such as the collapsed or folded protective housing 4, 4', the resilient reservoir 6, 6' without any medium inside, and the various ducts 22, 23, 30 and the interface 24, in a small van or even a station wagon.

When on site the operator may proceed with e.g. some or all of the following steps to install the modular insulation fluid handling system 1:

- Degassing the insulation oil in the transformer or reactor (this step is optional);
- The base 38 of the first protective housing 4, 4' is positioned, potentially close to the power transformer or inductive power device;

The sidewalls 4*o* are unfolded and fitted to the base 38, whereby the interface 24 is preferably arranged close to the vessel ventilation duct 30;

The resilient reservoir 6, 6' is placed in the protective housing 4, 4' and the adapter 10 is fixed to the lid 14 via pre-drilled holes in the lid 14, preferably from the inside of the protective housing 4, 4';

The lid is closed and locked in place;

The connector 16 or T-connector is connected to the adapter 10 and the interface connection duct 22, whereby the interface connection duct 22 may be flexible or cut to the right length;

If needed, further protective housings 4, 4' with resilient reservoirs 6, 6' are installed and connected to the according connectors 16 via the housing connection ducts 23;

The last outlet/inlet of the last connector 16 or T-connector is plugged with a plug 46 (c.f. FIGS. 4 and 5);

The ventilation duct terminal 28 of the interface 24 is connected to the vessel ventilation duct 30, for example via a 12 mm connector or any other suitably sized connector, which depends on the diameter of the vessel ventilation duct 30, and the vessel ventilation duct 30 is connected to the expansion vessel;

The system is filled with an inert gas, such as nitrogen, from a pressured cylinder via the filling valve 36, Optionally, the system is filled with the inert gas, e.g. nitrogen ($N_2$), until a back pressure regulator 34 opens and releases excess—gas. However, it may be more convenient to fill the reservoir(s) with an amount of gas (calculated based on i.a. operating temperature range) with a safety margin whereby no back-pressure regulator is needed and the reservoir(s) is closed against ambient;

The inert gas cylinder is closed, the filling valve 36 is closed and the modular insulation fluid handling system 1 is ready for use.

As an example each protective housing 4, 4' and resilient reservoir 6, 6' respectively may comprise 1 $m^3$ of volume. Any other size falls, however within the disclosure of the present invention.

According to an alternative aspect of the present invention, there is provided a modular insulation fluid handling system for protecting insulation fluid of an inductive power device having an expansion vessel and for handling volume variations of said insulation fluid. The modular insulation fluid handling system 1 comprises:

at least a first protective housing 4 comprising a resilient reservoir 6 filled with an inert gas and an adapter 10 sealably connected to the inside of the resilient reservoir;

an interface 24 comprising a ventilation duct terminal 28 and a reservoir terminal 32 being sealably connected to the adapter; and a vessel ventilation duct 30 configured to be sealably connected to the expansion vessel and the ventilation duct terminal 28.

The inside of the resilient reservoir is configured to be in hermetically sealed fluid communication with the expansion vessel via the adapter, the interface and the vessel ventilation duct. Thereby, the inert gas may be protected (e.g. completely) from ambient influences.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A modular insulation fluid handling system for protecting insulation fluid of an inductive power device having an expansion vessel and for handling volume variations of said insulation fluid, said modular insulation fluid handling system comprising:

at least a first protective housing comprising a resilient reservoir in the form of a flexible and/or foldable bag filled with an inert gas, a connector, and an adapter sealably connected to the inside of the resilient reservoir;

an interface comprising a ventilation duct terminal and a reservoir terminal being sealably connected to the adapter, wherein the connector is arranged between the adapter and the interface and configured to be connected to a connector of a second protective housing;

an interface connection duct that fluidically interconnects the interface and the adapter; and a vessel ventilation duct configured to be sealably connected to the expansion vessel and the ventilation duct terminal;

wherein the inside of the resilient reservoir is configured to be in hermetically sealed fluid communication with the expansion vessel via the adapter, the interface and the vessel ventilation duct.

2. The modular insulation fluid handling system according to claim 1, wherein the resilient reservoir comprises a multilayer polymer film or metal foil that prevents water and oxygen from entering into the resilient reservoir.

3. The modular insulation fluid handling system according to claim 2, wherein the multilayer polymer film comprises ethylene vinyl alcohol (EVOH) and/or polyvinylidene chlorid (PVDC).

4. The modular insulation fluid handling system according to claim 1, wherein the interface comprises a back pressure device configured to limit an overpressure of the inert gas in the closed volume.

5. The modular insulation fluid handling system according to claim 4, wherein an overpressure limit of the back pressure device in the closed volume is less than 0.5 bar, preferably less than 0.1 bar, more preferably less than 0.01 bar.

6. The modular insulation fluid handling system according to claim 1, wherein the protective housing is a collapsible plastic pallet container.

7. The modular insulation fluid handling system according to claim 1, wherein the interface comprises a filling valve fluidically connected to the adapter, said filling valve being used for filling and topping up the inert gas in the resilient reservoir.

8. The modular insulation fluid handling system according to claim 1, wherein the inert gas is nitrogen.

9. The modular insulation fluid handling system according to claim 1, comprising a housing connection duct, configured to interconnect the connectors of the at least first and second protective housings.

10. The modular insulation fluid handling system according to claim 9, wherein each protective housing and housing connection duct form a module so that the modular insulation fluid handling system can be extended in case a higher volume of inert gas is needed.

11. The modular insulation fluid handling system according to claim 1, wherein the interface comprises a filling valve fluidically connected to the adapter.

12. The modular insulation fluid handling system according to claim 1, wherein the adapter extends through a lid of the protective housing and the interface is on a side wall of the protective housing.

* * * * *